US006749767B2

(12) United States Patent
Mitani et al.

(10) Patent No.: US 6,749,767 B2
(45) Date of Patent: Jun. 15, 2004

(54) POWDER FOR HIGH STRENGTH DUST CORE, HIGH STRENGTH DUST CORE AND METHOD FOR MAKING SAME

(76) Inventors: Hiroyuki Mitani, c/o Kobe Corporate Research Laboratories in Kobe Steel, Ltd. 5-5, Takatsukadai 1-chome, Nishi-ku, Kobe-shi, Hyogo 651-2271 (JP); Tsukasa Yuri, c/o Kobe Corporate Research Laboratories in Kobe Steel, Ltd. 5-5, Takatsukadai 1-chome, Nishi-ku, Kobe-shi, Hyogo 651-2271 (JP); Kazuhisa Fujisawa, c/o Kobe Corporate Research Laboratories in Kobe Steel, Ltd. 5-5, Takatsukadai 1-chome, Nishi-ku, Kobe-shi, Hyogo 651-2271 (JP); Yoshikazu Seki, c/o Takasago Works in Kobe Steel, Ltd3-1, Shinhama 2-chome, Arai-cho, Takasago-shi, Hyogo 676-8670 (JP); Masahiro Murakami, c/o Takasago Works in Kobe Steel, Ltd3-1, Shinhama 2-chome, Arai-cho, Takasago-shi, Hyogo 676-8670 (JP); Hirofumi Houjou, c/o Takasago Works in Kobe Steel, Ltd3-1, Shinhama 2-chome, Arai-cho, Takasago-shi, Hyogo 676-8670 (JP)

( * ) Notice: Subject to any disclaimer, the term of this patent is extended or adjusted under 35 U.S.C. 154(b) by 219 days.

(21) Appl. No.: 10/099,980

(22) Filed: Mar. 19, 2002

(65) Prior Publication Data

US 2003/0047706 A1 Mar. 13, 2003

(30) Foreign Application Priority Data

Mar. 21, 2001 (JP) ..... 2001-081439

(51) Int. Cl.[7] ..... H01F 1/24

(52) U.S. Cl. ..... 252/62.54; 252/62.55; 148/104

(58) Field of Search ..... 252/62.54, 62.55; 148/104

(56) References Cited

U.S. PATENT DOCUMENTS 6,149,704 A * 11/2000 Moro et al. ..... 75/230

FOREIGN PATENT DOCUMENTS

| | | |
|---|---|---|
| JP | 55-138205 | 10/1980 |
| JP | 56-74902 | 6/1981 |
| JP | 62-232102 | 10/1987 |
| JP | 4-12605 | 3/1992 |
| JP | 9-272901 | 10/1997 |
| JP | 11-195520 | 7/1999 |
| JP | 2000-49008 | 2/2000 |

* cited by examiner

*Primary Examiner*—C. Melissa Koslow

(57) ABSTRACT

A mixed powder useful as a starting material for dust core comprises a uniform mixture of a soft magnetic powder and a binder resin so that the resultant dust core has an electric resistance capable of suppressing an eddy current between the soft magnetic powdery particles and high mechanical strength at room temperatures and also at high temperatures. In the mixed powder, the binder resin is made of a phenolic resin powder which has a methylol groups in the molecule and preferably has an average particle size of 30 μm or below and wherein when the phenolic resin powder is dissolved in boiling methanol in large excess, a content of an undissolved matter is at least 4 wt % based on the total of the phenolic resin. A dust core obtained from the mixed powder and its fabrication method are also described.

7 Claims, 4 Drawing Sheets

POWDER FOR HIGH STRENGTH DUST CORE, HIGH STRENGTH DUST CORE AND METHOD FOR MAKING SAME

BACKGROUND OF THE INVENTION

1. Field of the Invention

This invention relates to a dust core material mainly composed of soft magnetic powder, such as iron powder or iron-based alloy powder, and phenolic resin fine powder, a dust core obtained from such a material as mentioned above, and a method for making the same. The dust core obtained according to the invention exhibits excellent mechanical strength and magnetic properties at room temperatures and also at high temperatures.

2. Description of Related Art

In the core employed within an AC magnetic field, it is necessary that not only low iron loss, particularly low eddy current loss, and a magnetic flux density be high, but also no breakage take place in the course of handling in a manufacturing process and winding for making a coil. With a so-called dust core, the eddy current loss can be suppressed by causing an insulating resin to intervene between iron particles, and the resin serves as a bonding agent for the iron particles, so that it becomes possible to prevent the breakage while ensuring good mechanical strength.

It is conventionally known that dust cores are obtained by subjecting, to compaction molding in a desired form, mixtures of soft magnetic powder such as iron powder and organic binder resins such as epoxy resins, polyimide resins, silicone resins, phenolic resins, nylons or the like. Moreover, the dust core has been mass-produced in such a way that in order to reduce the mutual frictional resistance of powdery particles and frictional resistance with a die during the course of compaction molding, a lubricant, such as zinc stearate or lithium stearate, is mixed in an amount of approximately 0.8 to 1 wt % (e.g. Japanese Laid-open Patent Application Nos. Sho 56-74902 and Sho 62-232102, Japanese Patent Publication Nos. Sho 58-46044 and Hei 4-12605, Japanese laid-open Patent Application No. Hei 11-195520, and Japanese Patent Application No. 2000-49008).

Since a dust core is conventionally employed at room temperatures and has not been applied to parts requiring mechanical strength, mechanical strength, especially, at high temperatures has been aside from the question. Although known dust cores using such a resin as mentioned above have large mechanical strength at room temperatures, the mechanical strength lowers at a temperature as high as 100° C. or over owing to the glass transition or softening of the resin. When using a nylon resin among those resins indicated above, mechanical strength at a high temperature significantly lowers. This tendency is true of hot cured resins such as epoxy resins, polyimide resins, phenolic resins and the like. Thus, where the core is used at high temperatures or becomes high in temperature due to the generation of heat in use, it has been difficult to apply to parts that require satisfactory mechanical strength.

For a technique of improving mechanical strength of dust core, it has been proposed to use a lubricant mixed with starting materials, which has a melting point higher than a curing temperature of a curable binder resin (Japanese Patent Publication No. Hei 4-12605). However, because the real strength of the dust core is determined depending on the bonding force or adhesion force of binder resin, such a technique as mentioned above wherein a lubricant that impedes the bonding between iron powder and resin is merely excluded only in the course of curing the binder resin has been unsatisfactory for improving mechanical strength at high temperatures.

Besides, for a measure of improving the a green density, there is proposed a technique wherein a lubricant is applied onto the inner wall surfaces of a die without addition of a lubricant in a starting mixed powder (Japanese laid-open Patent Application No. Hei 9-272901). Since the lubricant acts to impede the bonding between the iron powder (soft magnetic powder) and the resin thereby causing mechanical strength to be lowered, it can be expected that this technique is effective for improving not only the green density, but also the green strength. However, in order to improve mechanical strength at high temperatures, it is necessary to improve the mechanical strength of a binder resin per se as stated hereinabove.

Further, it is required to impart satisfactory electric insulating properties so as to suppress the eddy current loss. From this point of view, it is necessary to uniformly mix a binder resin and a soft magnetic powder prior to compaction. The uniformity of such a mixture of soft magnetic powder/binder resin is important from the standpoint of improving the mechanical strength of the dust core obtained by compacting the mixture. In this connection, however, a phenolic resin is, for example, in the form of a liquid, a mass or flakes and has to be mixed with soft magnetic powder after dissolution in a hydrocarbon solvent such as toluene, xylene hexane or the like, with a difficulty in working properties.

SUMMARY OF THE INVENTION

An object of the invention is to provide a mixed powder which is a uniform mixture of a soft magnetic powder and a binder resin, has such an electric resistance that an eddy current mutually occurring in-between soft magnetic powder particles can be suppressed, and has high mechanical strength, thus being suited as a starting material for dust core.

Another object of the invention is to provide a dust core obtained from such a mixed powder as mentioned above.

A further object of the invention is to provide a method for making such a dust core.

The above objects can be achieved, according to the invention, by a powder for high strength dust core (which may be sometimes referred to merely as "powder for dust core") which comprises a soft magnetic powder and a powder of a phenolic resin wherein when 1 g of the phenolic resin is dissolved in 100 ml of boiling methanol, an undissolved matter is left in an amount of at least 4 wt % based on the total amount of the phenolic resin.

The phenolic resin fine powder should preferably have an average particle size of 30 $\mu$m or below. The use of the resin powder having such an average particle size ensures more uniform mixing with a soft magnetic powder.

The content of the phenolic resin fine powder in the mixed powder for dust core should preferably range from 0.5 to 5 wt %. It is recommended that the mixed powder further comprises at least 0.2 wt % of a lubricant. It will be noted that in case where the powder for dust core is used for a compaction process using a die that is applied with a lubricant on the inner wall surfaces thereof, the amount of the lubricant should preferably be not larger than 0.2 wt % (inclusive of 0 wt %).

The high strength dust core (which may be sometimes referred to merely as "dust core") of the invention is one that is obtained by curing the phenolic resin present in a compaction product of the powder for dust core. More particularly, the method for making a high strength dust core according to the invention comprises the steps of compacting the above-defined powder for dust core and curing the phenolic resin in the resulting compaction product.

BRIEF DESCRIPTION OF THE ACCOMPANYING DRAWINGS

DETAILED DESCRIPTION OF THE PREFERRED EMBODIMENTS

Figure 1:
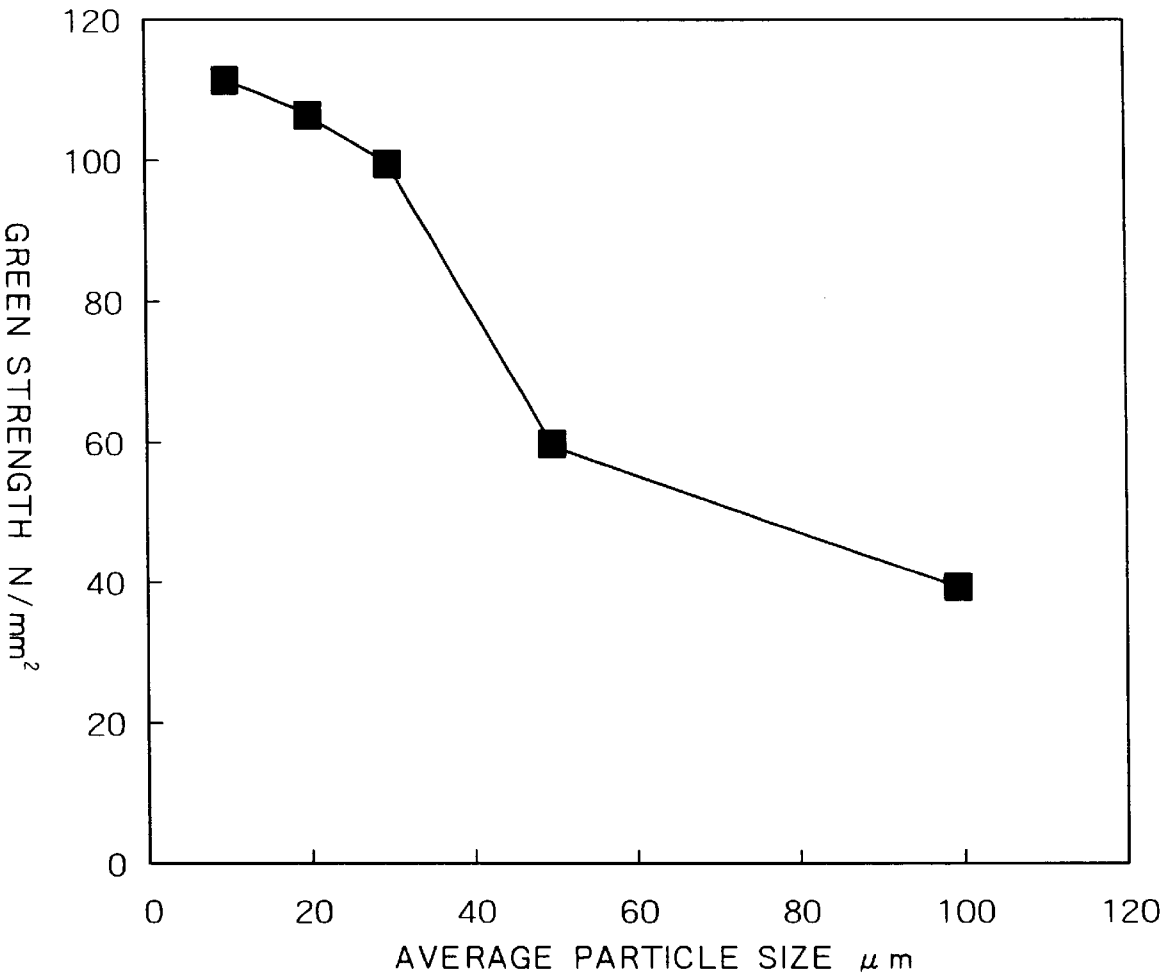
FIG. 1 is a graph showing the relation between the green strength of a dust core and the average particle size of an employed phenolic resin powder.

The term "dust core" used herein is intended to mean electromagnetic parts which are obtained by mixing, with a soft magnetic powder, a binder resin for imparting electric insulation and mechanical strength to the core and, optionally, a lubricant for reducing friction in the course of compaction molding, compacting the resulting mixture in a desired form, and curing the binder resin in the resulting compaction and which is called core mainly used in an AC magnetic field.

The soft magnetic powder is a ferromagnetic metal powder and specific examples include pure iron powder, iron-based alloy powders (such as those of Fe—Al alloys, Fe—Si alloys, sendust, permalloy and the like), amorphous powder, iron powder having an electrically insulating coating, such as a phosphate coating or an oxide layer, on the surface thereof, and the like. Such a soft magnetic powder can be prepared, for example, by dividing into fine particles by an atomization process, followed by reduction and pulverization. According to such a procedure as mentioned above, there can be obtained a soft magnetic powder having an average particle size of approximately 20 to 250 $\mu$m wherein a integrated particle size distribution in terms of the particle size distribution evaluated by a sieve analysis is at 50%. In the practice of the invention, a soft magnetic powder having an average particle size of approximately 50 to 150 $\mu$m is preferably used.

The powder for dust core according to the invention comprises such a soft magnetic powder as set out above and a fine powder of a phenolic resin wherein the phenolic resin serves as a binder resin. The phenolic resin is a hot cured resin, and when it undergoes heat treatment after compaction to cause crosslinking reaction to proceed or is hot cured, a dust core having good mechanical strength can be obtained. In this sense, the phenolic resin used in the invention should preferably be of a self-crosslinking type having methylol groups in the molecule. The phenolic resin used in the present invention may be obtained by heat treating, for example, a commercially available phenolic resin.

In order to obtain a dust core whose electric resistance and mechanical strength are good, it is essential that a soft magnetic powder and a phenolic resin be uniformly mixed prior to compaction. As stated hereinabove, the phenolic resin is usually in the form of a liquid, a mass or flakes. When a solid resin is used, its particle size is larger by ten times or more than the average particle size of the soft magnetic powder, under which uniform mixing with the soft magnetic powder needs the use of a phenolic resin dissolved in solvent. In contrast, with the powder for dust core according to the invention, a fine powder of a phenolic resin is used, so that uniform mixing with a soft magnetic powder in the absence of a solvent is achieved, thereby ensuring the fabrication of a dust core having excellent electric resistance and mechanical strength.

From the standpoint of such uniform mixing, the phenolic resin fine powder used in the invention should preferably have an average particle size much smaller than the soft magnetic powder, and it is recommended that its average particle size is preferably 30 $\mu$m or below, more preferably 20 $\mu$m or below and most preferably 10 $\mu$m or below. It will be noted that the term "average particle size" used herein means an average value of particle sizes (i.e. an average value of major and minor diameters or lengths), which is determined by directly measuring 100 single particles (i.e. not particles each made of a plurality of particles being coagulated, but particles existing individually or singly) of a phenolic resin randomly selected from a photograph (magnification: ×400) of a phenolic resin fine powder taken by use of a scanning electron microscope. It is to be noted that the terms "major diameter" and "minor diameter", respectively, mean maximum and minimum distances between the two arbitrary parallel lines drawn in contact with the profile of a particle.

The phenolic resin fine powder having such a size as defined above may be obtained by pneumatic classification, for example, of a mass or flakes after division into fine pieces, if necessary. Besides, with a phenolic resin having a high molecular weight, the fine powder can be obtained by dropping a phenolic resin solution, which is obtained by dissolution in a good solvent, in a bad solvent in large excess to cause the phenolic resin to be precipitated, thereby collecting the resulting precipitate. In this case, the average particle size can be appropriately controlled by controlling the concentration of the phenolic resin solution.

In the practice of the invention, it is preferred that while the phenolic resin has methylol groups ensuring self crosslinkage, crosslinkage has proceeded to some extent sufficient to convert to a polymeric form. When a phenolic resin is cured thereby causing a crosslinked structure to be developed, mechanical strength becomes great and does not undergo softening along with a small influence of glass transition. As a result, the lowering of mechanical strength at high temperatures is not observed. The mechanical strength of a dust core depends on the mechanical strength of a binder resin, so that when a compaction using a phenolic resin whose crosslinked structure is not relatively developed is cured, the crosslinkage of the phenolic resin proceeds, thereby enabling mechanical strength at normal and high temperatures to be improved.

However, when using a phenolic resin whose crosslinked structure is not developed, curing takes a long time. The curing time of a practical level (i.e. approximately 2 hours or below) cannot suppress the lowering of mechanical strength at high temperatures. This is why it is preferred to use a phenolic resin wherein crosslinkage proceeds to some extent sufficient to convert to a polymeric form.

More particularly, it is recommended to use such a phenolic resin that when 1 g of the phenolic resin is dissolved in 100 ml of boiling methanol, the resultant undissolved matter is present in an amount of at least 4 wt %, preferably not smaller than 5 wt %, based on the total amount of the phenolic resin. The solubility of a phenolic resin in boiling methanol depends on the amount of methylol groups present in the molecule of the phenolic resin. It is considered that a resin having a larger number of the groups is more likely to be dissolved.

Nevertheless, as crosslinkage reaction proceeds, the methylol groups are consumed with a reduction in number, so that it is assumed that a matter not dissolved in boiling methanol (or undissolved matter) is caused to occur.

More particularly, a phenolic resin of the type whose undissolved matter is present in an amount smaller than the above-defined lower limit has undergone little crosslinkage. When such a resin as mentioned above is used for making a dust core under practical, curing time conditions as set out above, satisfactory mechanical strength, particularly, at high temperatures is not assured. It is recommended that the undissolved matter is present in amounts of 30% or below, preferably 20% or below, based on the total amount of phenolic resin. With a phenolic resin whose undissolved matter content exceeds the above range, the reaction in the course of curing proceeds so quickly that a non-uniform crosslinkage structure is formed, and thus, the resulting cured product (dust core) becomes embrittled.

The amount of the undissolved matter in a phenolic resin is determined according to the following method. A phenolic resin with an accurate weight $W_1$ is charged into methanol at a rate of 1 g of the phenolic resin per 100 ml of methanol and subjected to Soxhlet extraction at 80° C. for 20 hours, followed by filtration with a glass filter that is able to retain phenolic resin particles with a size of 7 $\mu$m or over. The resulting filtrate is evaporated to dryness to measure a weight $W_2$ of a dried residue, and an amount X of an undissolved matter is calculated according to the following equation:

$$X=100\times\{1-(W_2/W_1)\} \quad (1)$$

It will be noted that the amount of the undissolved matter in the phenolic resin particles existing in the powder for dust core can be determined according to the above method after separating a soft magnetic powder by magnetic separation, separating a lubricant via filtration by use of a solvent capable of dissolving the lubricant alone, if present, and collecting the phenolic resin alone.

It is preferred that the phenolic resin should be contained in an amount of not less than 0.5 wt %, more preferably not less than 0.7 wt %, based on the total of the powder so as to ensure mechanical strength after formation of a dust core. On the other hand, if the amount of a phenolic resin is increased, mechanical strength and electric insulating properties are improved, but the percentage by volume of a soft magnetic powder in the dust core decreases thereby causing magnetic properties to be lowered. Hence, it is favorable that the phenolic resin is contained in an amount of 5 wt % or below, preferably 2 wt % or below based on the total of the powders.

The powder for dust core according to the invention should preferably contain a lubricant. The lubricant acts to reduce the friction resistance between soft magnetic powdery particles or between the soft magnetic powder and the inner walls of a die when the powder for dust core is compacted, thereby preventing a compaction or compacted product from being dragged with a die or the generation of heat during compaction. In order to effectively show such an effect as set out above, it is recommended that the lubricant is contained in an amount of at least 0.2 wt %, preferably 0.5 wt % or over, based on the total amount of the powders. On the other hand, if a lubricant is added to in larger amounts, its effect is saturated, with the tendency that the bonding between the soft magnetic powder and the phenolic resin may be impeded to lower the mechanical strength of the resultant compaction (dust core) or the percentage by volume of the soft magnetic powder in the compaction decreases thereby causing magnetic properties to be lowered. Thus, it is preferred that the upper limit is at 1 wt %, more preferably 0.8 wt % or below, based on the total amount of the powders The lubricants may be ones ordinarily employed in the compaction of a dust core and specific examples include powders of metallic salts of stearic acid such as zinc stearate, lithium stearate, calcium stearate and the like, paraffins, wax, natural or synthetic resin derivatives and the like.

In the practice of the invention, when using a compaction which is applied with a lubricant on the inner wall surfaces thereof, the amount of a lubricant in the powder for dust core can be further reduced by reducing the friction resistance between the soft magnetic powder and the inner walls of the die in the course of compaction of the powder for dust core. In this case, the amount of the lubricant is recommended to be 0.2 wt % or below, preferably 0.1 wt % of below, based on the total amount of the powders. This enables the fabrication of a dust core having more excellent mechanical strength and magnetic properties. It will be noted that where such a die as mentioned above is used, it is possible to obtain a compaction that is free of a die-dragging defect if the powder for dust core does not contain any lubricant therein.

The powder for dust core of the invention is prepared by uniformly mixing such soft magnetic powder and phenolic resin fine powder as set forth hereinabove and, optionally, a lubricant in such amounts as defined above. The manner of mixing is not critical and any known procedures may be adopted.

The dust core of the invention is made by use of the above-stated powder for dust core. The method for making the core comprises the steps of:

(1) compacting a powder for dust core; and (2) hot curing a phenolic resin in the green compaction.

In the above step (1), the compaction method is not critical and any conventional methods may be adopted. As stated hereinbefore, the use of a die whose inner walls are applied with a lubricant thereon is preferred from the standpoint that the amount of a lubricant in the powder for dust core can be reduced.

The lubricants applied to the inner wall surfaces of a die are not particularly limitative, and typical examples include metallic salts of stearic acid such as, for example, zinc stearate, lithium stearate, calcium stearate and the like, which may be applied to in the form of powder or after dissolution in an organic solvent. Aside from the above lubricants, those materials having lubricity, such as graphite, molybdenum disulfide and the like may also be used.

Preferred compacting conditions include a pressure of from 290 MPa to 1200 MPa, more preferably from 390 MPa to 1000 MPa, and a compacting time under a maximum load of from 0.05 to 5 seconds, more preferably from 0.1 to 3 seconds. It should be noted that if the die temperature becomes too high, the phenolic resin may undergo curing prior to the shaping of a compacting or green compaction, so that the compaction has to be performed at room temperatures to lower than 150° C.

In the above step (2), the phenolic resin in the green compaction is cured. The manner of the curing is not critical, and any conventional methods may be used. It is recommended to effect the curing at a temperature of 150° C. or over at which the crosslinking reaction of phenolic resin proceeds, preferably at 180° C. or over, but at a temperature of 380° C. or below from the standpoint of preventing the thermal degradation of phenolic resin, preferably at 300° C. or below. The curing time may vary, more or less, depending on the selected curing temperature and it is recommended to use from 1 minute to 2 hours, preferably from 3 minutes to 1 hour. The adoption of such curing conditions not only permits the crosslinkage of phenolic resin to proceed satisfactorily, but also prevents the phenolic resin from undergoing degradation.

The thus obtained dust core of the invention exhibits excellent mechanical strength and magnetic properties at room temperatures and further at high temperatures.

The invention is more particularly described by way of examples, which should not be construed as limiting the invention thereto, and many variations and alterations may be made without departing from the spirit of the invention.

Experiment 1

Pure iron powder (300 NH, made by Kobe Steels Co., Ltd.) provided as a soft magnetic powder, fine powders of a phenolic resin (with an undissolved matter of 5 wt %) having different average particle sizes indicated in Table 1, a lubricant (lithium stearate) were, respectively, weighed, followed by mixing by use of a C-type mixer for 30 minutes or over to obtain uniformly mixed powders for dust core (containing 1 wt % of the phenolic resin fine powder and 0.1 wt % of the lubricant). It will be noted that the average particle size of the phenolic resin fine powder was determined according to the afore-stated method.

Each powder for dust core was charged into a die and compaction under conditions of a temperature of 20° C., a compacting pressure of 800 MPa and a compacting time of 2 seconds under maximum load. Thereafter, the phenolic resin in the green compaction was cured in air under conditions of 200° C.×10 minutes to obtain a 31.8 mm in length×12.7 in width×5 mm in thickness parallelopipedon-shaped dust core. The compacting was performed by use of a die which was coated with a dispersion of a lubricant (zinc stearate) in ethanol onto the inner wall surfaces thereof by means of a brush.

The resultant dust core was subjected to measurement of green strength at room temperatures. The green strength test was carried out according to a testing method prescribed in ISO 3325 (flexural force of sintered metal materials). The testing device used as "Autograph AG-5000E" made by Shimadzu Corporation, with a distance between fulcrums being set at 25 mm. The results are shown in Table 1. Moreover, FIG. 1 shows the relation between the green strength of dust core and the average particle size of the employed phenolic resin powders.

TABLE 1

| Experiment No. | Average particle size of phenolic resin powder ($\mu$m) | Green strength (N/mm$^2$) |
|---|---|---|
| 1-1 | 10 | 112 |
| 1-2 | 20 | 107 |
| 1-3 | 30 | 100 |
| 1-4 | 50 | 60 |
| 1-5 | 100 | 40 |

As will be apparent from Table 1 and FIG. 1, the use of a smaller average particle size of the phenolic resin powder, i.e. a finer powder, results in a dust core having larger green strength. In particular, the dust core using a phenolic resin fine powder having such an average particle size within a preferred range of the invention exhibits very great green strength.

Experiment 2

Powders for dust core (containing 1 wt % of a phenolic resin fine powder and 0.1 wt % of a lubricant) were, respectively, prepared in the same process as in Experiment 1 using two types of phenolic resin fine powders including a powder having a content of undissolved matter of 5 wt % (resin A, BELLPEARL S899, made by Kanebo Co., Ltd.) and a powder having a content of undissolved matter of 2 wt % (resin B, BELLPEARL S890, made by Kanebo Co., Ltd.). The average particle sizes of the resins A and B were, respectively, at 20 $\mu$m.

In the same process as in Experiment 1, dust cores were made by use of the powders for dust core, and green strength was measured at different temperatures indicated in Table 2. The green strength test at high temperatures, e.g. measurement at 200° C., was performed such that an oven furnace was used and a measuring sample was kept in air under an environment of 200° C. for 30 minutes, followed by completing the test within 3 minutes after removal from the oven furnace. The results are shown in Table 2. Moreover, FIG. 2 shows the relation between the green strength of a dust core and the measuring temperature.

TABLE 2

| Experiment No. | Phenolic resin | Green density (g/cm$^3$) | Green strength (N/mm$^2$) at different measuring temperatures: Room temperature | 50° C. | 100° C. | 150° C. |
|---|---|---|---|---|---|---|
| 2-1 | A | 7.15 | 112 | 110 | 114 | 115.9 |
| 2-2 | B | 7.15 | 122 | 120 | 60 | 35.1 |

Figure 2:
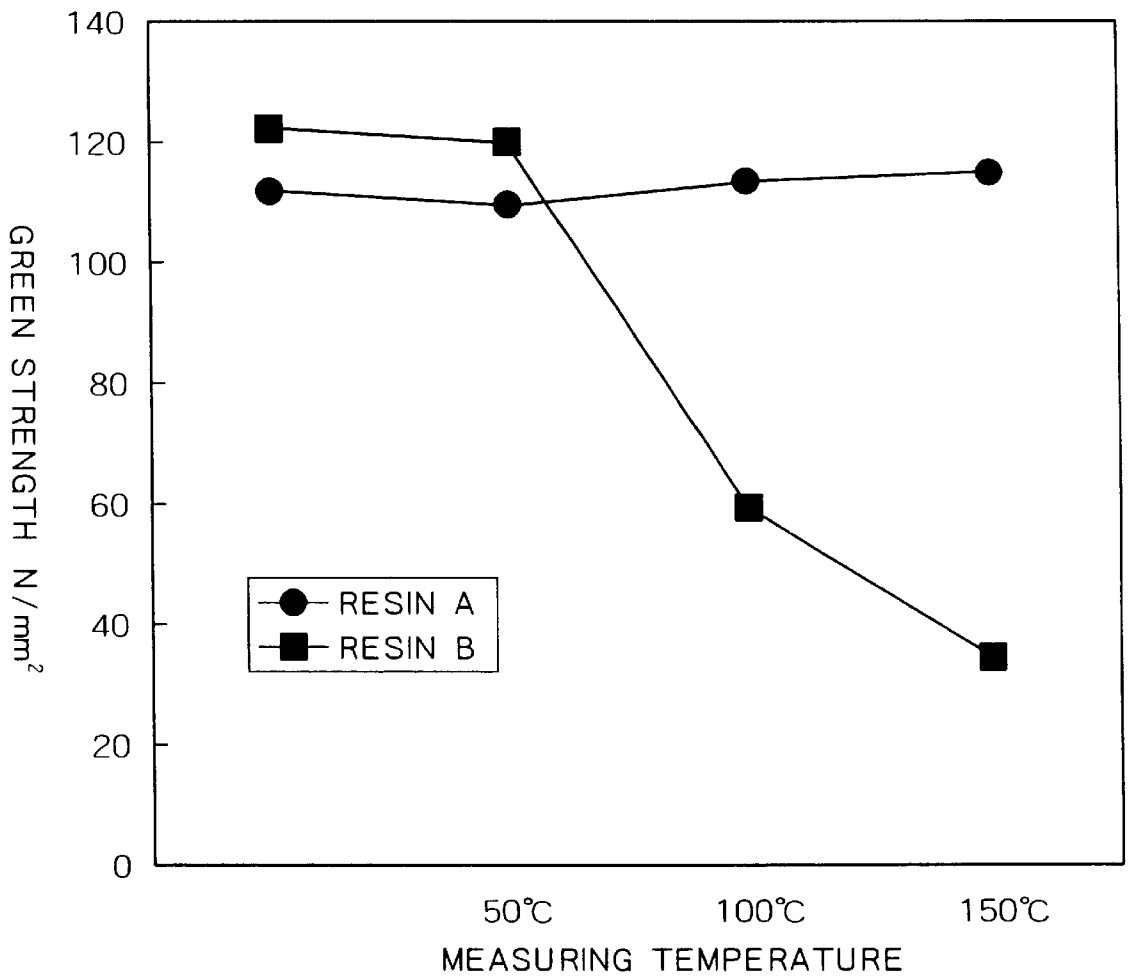
FIG. 2 is a graph showing the relation between the green strength of a dust core and the measuring temperature.

As will become apparent from Table 2 and FIG. 2, with the dust core using the resin A (with an undissolved matter content of 5 wt %) whose undissolved matter content is within a preferred range of the invention, the green strength is substantially constant irrespective of the measuring temperature and is good not only at room temperatures, but also at temperatures as high as 100° C. or over. In contrast, with the dust core using the resin B (with an undissolved matter content of 2 wt %) whose undissolved matter content is lower than a preferred range of the invention, the green strength at room temperatures is excellent, but the green strength decreases with an increasing measurement temperature. It will be noted that when both resins A and B, respectively, have a large particle size, the green strength at room temperatures lowers. With the resin whose undissolved matter content is within a preferred range of the invention, however, the green strength is kept substantially constant up to a higher temperature range.

Experiment 3

The resin A (having an average particle size of 20 $\mu$m) used above was used as a phenolic resin fine powder, and powders for dust core (with a lubricant content of 0.06 wt %) were prepared in the same process as in Experiment 1 using such contents as indicated in Table 3. Individual powders for dust core were compacted in the same process as in Experiment, and were cured under conditions indicated in Table 3 to make dust cores, followed by measurement of green strength at room temperatures. The results are shown in Table 3 and also in FIG. 3.

TABLE 3

| Experiment No. | Phenolic resin content (wt %) | Green strength (N/mm²) A | b | c | d |
|---|---|---|---|---|---|
| 3-1 | 0.2 | 20 | 27 | 50 | 55 |
| 3-2 | 0.5 | 40 | 60 | 100 | 120 |
| 3-3 | 1 | 42.1 | 63.1 | 120 | 133.9 |
| 3-4 | 2 | 59.2 | 76.9 | 132 | 140 |
| 3-5 | 3 | 59.6 | 69.8 | 125 | 135 |

Figure 3:
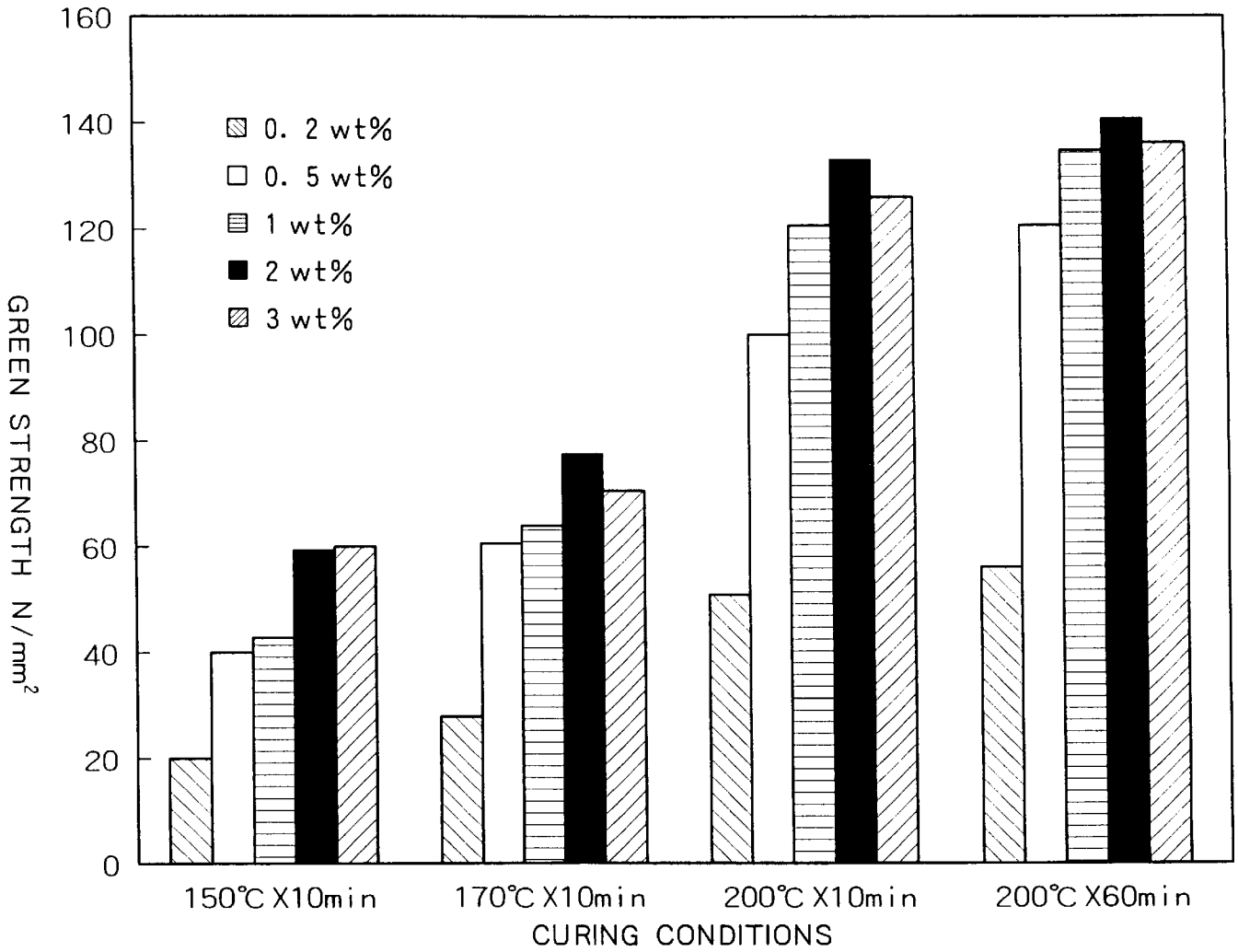
FIG. 3 is a graph showing the relation between the green strength of a dust core and the content of a phenolic resin fine powder for different curing conditions.

Curing conditions of dust core
a: 150° C. × 10 minutes
b: 175° C. × 10 minutes
c: 200° C. × 10 minutes
d: 200° C. × 60 minutes As will become from Table 3 and FIG. 3, the dust core obtained form the powder for dust core wherein the content of the phenolic resin fine powder is within the range of the invention exhibits better green strength, irrespective of curing conditions, than the dust core wherein the content is below the range of the invention. Moreover, within a range where the phenolic resin underwent no degradation, a high curing temperature and a longer curing time lead to greater green strength of the resulting dust core.

Experiment 4

In the same process as in experiment 1, powders for dust core (resin A: 1 wt %) were obtained using the resin A (with an average particle size of 20 μm) as a phenolic resin fine powder and a lubricant in amounts indicated in Table 4. The powder for dust core was used and compacted in the same process as in Experiment 1 except that a die whose inner wall surfaces were not applied with any lubricant was used, followed by evaluation of compactibility. The evaluation standards were as follows: a case where a die-dragging defect was recognized on a green compaction was assessed as "○" and a case where the dragging defect was recognized was as "X". The results are shown in Table 4.

TABLE 4

| Experiment No. | Content of lubricant (wt %) | Compactibility |
|---|---|---|
| 4-1 | 0.15 | X |
| 4-2 | 0.2 | ○ |
| 4-3 | 0.5 | ○ |
| 4-4 | 1 | ○ |

As will become apparent from Table 4, the green compaction obtained from the powder for dust core wherein the content of the lubricant is below the range of the invention was recognized as having a die-dragging defect. With the green compaction obtained from the powder for dust core obtained within a range of the invention, no die-dragging defect was recognized on the compaction with good compactibility.

Experiment 5

Figure 4:
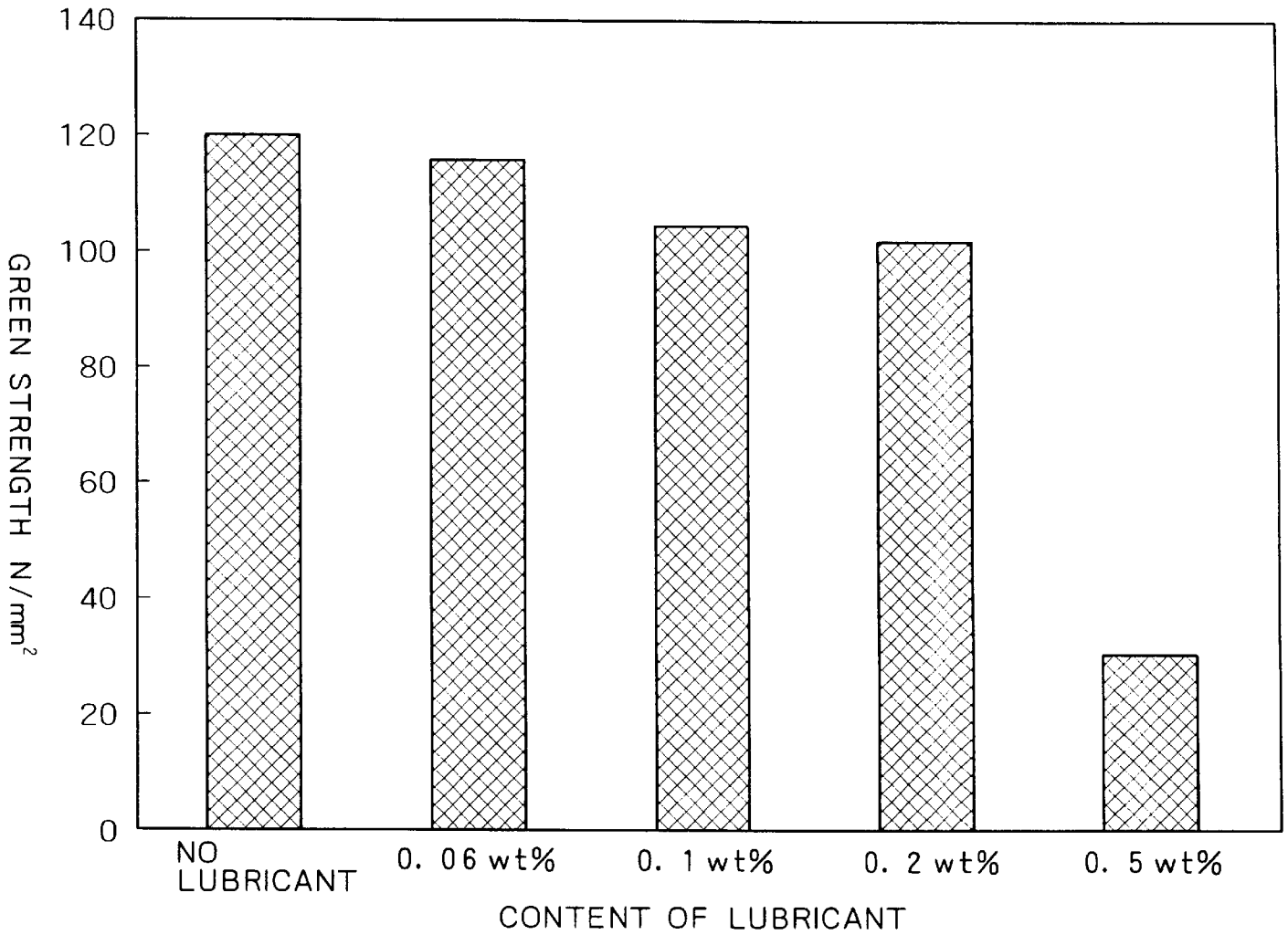
FIG. 4 is a graph showing the relation between the green strength of a dust core obtained by a compaction process using a die applied with a lubricant on the inner wall surfaces thereof and the amount of the lubricant.

In the same process as in Experiment 1 using the afore-indicated resin A (with an average particle size of 20 mm) and a lubricant in amounts indicated in Table 5, powders for dust core (resin A: 1 wt %) were obtained. The powders for dust core were each subjected to compacting in the same process as in Experiment 1 to evaluate compactibility according to the standards of Experiment 4. The results are shown in Table 5. Further, the resultant compactings were cured in the same process as in Experiment 1 to provide dust cores, followed by measurement of green strength at room temperatures. The results are shown in Table 5 and FIG. 4.

TABLE 5

| Experiment No. | Content of lubricant (wt %) | Compactibility | Green strength (N/mm²) |
|---|---|---|---|
| 5-1 | 0 | O | 120 |
| 5-2 | 0.06 | O | 116 |
| 5-3 | 0.1 | O | 105 |
| 5-4 | 0.2 | O | 102 |
| 5-5 | 0.5 | O | 30 |

As will be apparent from Table 5 and Dig. 4, die dragging-free compactings are obtained in all the contents of the lubricant, and if the content of the lubricant is within a preferred range of the invention, there can be obtained dust cores having very high green strength. In this way, when using a die that is applied with a lubricant on the inner wall surfaces thereof, it becomes possible to reduce the amount of the lubricant in the powder for dust core, thereby obtaining a dust core having no die dragging and great green strength.

The invention is so arranged as stated hereinabove and can provide a mixed powder for dust core, in which a binder resin used is made of a phenolic resin powder wherein when 1 g of the resin is dissolved in 100 ml of boiling methanol, the content of an undissolved matter is at least 4 wt % based on the total of the resin, so that the mixed powder enables the fabrication of a dust core having excellent mechanical strength, electric resistance and magnetic properties, and also a high strength dust core obtained from the mixed powder and a method for making the dust core. The powder for dust core according to invention is a uniform mixture of a soft magnetic powder and a phenolic resin powder, so that working properties are good in view of the fact that a solvent is unnecessary.

What is claimed is:

1. A powder for high strength dust core comprises a soft magnetic powder and a powder of a phenolic resin powder wherein when said phenolic resin is dissolved in boiling methanol at a rate of 1 g of said phenolic resin per 100 ml of the boiling methanol, a content of an undissolved matter is at least 4 wt % based on the total of said phenolic resin.

2. A powder for high strength dust core according to claim 1, wherein the phenolic resin powder has an average particle size of 30 μm or below.

3. A powder for high strength dust core according to claim 1, wherein said phenolic resin powder is contained in an amount of 0.5 to 5 wt %.

4. A powder for high strength dust core according to claim 1, further comprising a lubricant in an amount of at least 0.2 wt %.

5. A powder for high strength dust core according to claim 1, wherein a lubricant is contained in an amount of 0.2 wt % or below, inclusive of 0 wt %, and said powder for high strength dust core is used for a compacting process which makes use of a die whose inner wall surfaces are applied with a lubricant thereon.

6. A dust core characterized in that said dust core is obtained by curing a phenolic resin present in a green compaction of a powder for high strength dust cure recited in claim 1.

7. A method for making a high strength dust core, characterized by comprising the steps of compacting a powder for high strength dust core recited in claim 1, and curing a phenolic resin present in the resulting green compaction.

* * * * *

UNITED STATES PATENT AND TRADEMARK OFFICE

CERTIFICATE OF CORRECTION

PATENT NO. : 6,749,767 B2
DATED : June 15, 2004
INVENTOR(S) : Mitani et al.

It is certified that error appears in the above-identified patent and that said Letters Patent is hereby corrected as shown below:

Title page,
Insert Item -- [73], Assingee: Kabushiki Kaisha Kobe Seiko Sho (Kobe Steel, Ltd.), Kobe (JP) --
Insert Item -- [74], *Attorney, Agent, or Firm* – Oblon, Spivak, McClelland, Maier & Neustadt, P.C. --

Signed and Sealed this

Thirty-first Day of August, 2004

JON W. DUDAS
*Director of the United States Patent and Trademark Office*

UNITED STATES PATENT AND TRADEMARK OFFICE

CERTIFICATE OF CORRECTION

PATENT NO. : 6,749,767 B2
DATED : June 15, 2004
INVENTOR(S) : Mitani et al.

It is certified that error appears in the above-identified patent and that said Letters Patent is hereby corrected as shown below:

Title page,
Insert Item -- [73], Assignee: Kabushiki Kaisha Kobe Seiko Sho (Kobe Steel, Ltd.), Kobe (JP) --
Insert Item -- [74], *Attorney, Agent, or Firm* – Oblon, Spivak, McClelland, Maier & Neustadt, P.C. --

This certificate supersedes Certificate of Correction issued August 31, 2004.

Signed and Sealed this

Ninth Day of November, 2004

JON W. DUDAS
*Director of the United States Patent and Trademark Office*